US008337238B2

(12) United States Patent
Tobey et al.

(10) Patent No.: US 8,337,238 B2
(45) Date of Patent: Dec. 25, 2012

(54) CABLE CLIP FOR A CONNECTOR ASSEMBLY

(75) Inventors: Shawn Phillip Tobey, Trinity, NC (US); Robert Jeffrey Burwell, Staley, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 15 days.

(21) Appl. No.: 12/838,570

(22) Filed: Jul. 19, 2010

(65) Prior Publication Data

US 2012/0015551 A1 Jan. 19, 2012

(51) Int. Cl.
*H01R 13/58* (2006.01)

(52) U.S. Cl. ..... 439/460; 439/607.02

(58) Field of Classification Search ..... 439/460, 439/465, 470–472, 607.02, 607.23, 607.25, 439/607.53

See application file for complete search history.

(56) References Cited

U.S. PATENT DOCUMENTS

| | | | | |
|---|---|---|---|---|
| 4,611,878 | A * | 9/1986 | Hall et al. | 439/607.47 |
| 4,822,286 | A * | 4/1989 | Bianca | 439/607.45 |
| 5,417,590 | A * | 5/1995 | Dechelette et al. | 439/607.48 |
| 5,639,261 | A | 6/1997 | Rutkowski et al. | |
| 5,647,765 | A | 7/1997 | Haas et al. | |
| 5,735,712 | A | 4/1998 | Haas et al. | |
| 5,755,597 | A * | 5/1998 | Panis et al. | 439/607.47 |
| 6,066,001 | A | 5/2000 | Liptak et al. | |
| 6,074,251 | A | 6/2000 | Edgerly et al. | |
| 6,227,911 | B1 | 5/2001 | Boutros et al. | |
| 6,231,392 | B1 * | 5/2001 | van Woensel | 439/607.44 |
| 6,269,008 | B1 | 7/2001 | Hsu | |
| 6,540,564 | B1 | 4/2003 | Ko | |
| 6,655,988 | B1 | 12/2003 | Simmons et al. | |
| 6,780,035 | B2 | 8/2004 | Bohbot | |
| 6,802,735 | B2 | 10/2004 | Pepe et al. | |
| 6,976,867 | B2 | 12/2005 | Navarro et al. | |
| 7,033,210 | B1 | 4/2006 | Laurer et al. | |
| 7,077,707 | B2 | 7/2006 | Hyland et al. | |
| 7,357,675 | B2 | 4/2008 | Barringer et al. | |
| 2004/0229501 | A1 | 11/2004 | Caveney et al. | |
| 2004/0246693 | A1 | 12/2004 | Lloyd et al. | |
| 2005/0136747 | A1 | 6/2005 | Caveney et al. | |
| 2005/0164548 | A1 | 7/2005 | Spears et al. | |
| 2005/0282432 | A1 | 12/2005 | Murr et al. | |

FOREIGN PATENT DOCUMENTS

DE 24 05 885 8/1975

(Continued)

OTHER PUBLICATIONS

European Search Report, European Application No. EP 11 17 4342.3, European Filing Date Jul. 18, 2011.

(Continued)

*Primary Examiner* — Thanh Tam Le

(57) ABSTRACT

A connector assembly includes a shielded housing having a cavity. The shielded housing has a mating end and a cable end configured to receive a cable therethrough. A plug is received in the cavity that has terminals extending between mating ends and wire terminating ends. The wire terminating ends being configured to be terminated to corresponding wires of the cable. A cable clip is received in the shielded housing proximate to the cable end. The cable clip has a base and a bonding arm extending from the base. The base engages and is electrically connected to the shielded housing. The bonding arm is positioned in the cavity and is configured to engage a cable shield of the cable to electrically connect the cable shield and the shielded housing.

19 Claims, 6 Drawing Sheets

FOREIGN PATENT DOCUMENTS

| | | | |
|---|---|---|---|
| EP | 1 538 715 | A2 | 6/2005 |
| EP | 1 914 844 | A2 | 4/2008 |
| WO | WO 2005/052426 | A2 | 6/2005 |
| WO | WO 2008/071917 | A1 | 6/2008 |

OTHER PUBLICATIONS

De Dios, L., AMP-Twist 7AS4P Plug, T.E. P/N 1711498, Dec. 12, 2008, p. 1, Tyco Electronics, US.

* cited by examiner

CABLE CLIP FOR A CONNECTOR ASSEMBLY

BACKGROUND OF THE INVENTION

The subject matter herein relates generally to data communication systems, and more particularly, to connector assemblies for data communication systems.

Data communication systems have many applications, including telecommunications and interconnecting computers over local area networks. Application demands are driving systems to have increased electrical performance while increasing the density of connectivity. Some known systems strive to maximize the number of contact pairs within a connector to make installation orderly and efficient. However, such systems are not without disadvantages. For instance, with increased numbers of contact pairs, and as products become more densely arranged, known systems and connectors are challenged to perform wire termination and assemble the connectors. Difficulties arise in achieving desired electrical transmission performance due to interference and signal degradation, such as from cross-talk between contact pairs. While some systems attempt to provide electrical isolation between components by surrounding them with materials that effectively provide shielding from cross-talk, providing such shielding in a limited space while maintaining an acceptable termination and assembly process has proven problematic. Additionally, electrical bonding between the shield of the cable and the shield of the connector is desired. Due to size constraints, electrical bonding may be difficult. Additionally, some known connectors include bonding features that are made up of several components, which can be costly from a manufacturing standpoint and from an assembly standpoint. Furthermore, such bonding features may impede the wire termination and cable assembly process to the plug.

A need remains for a communication system that achieves high transfer rates with desirable system performance and space utilization. A need remains for a connector that includes a bonding path between the cable and the connector in a cost effective and reliable manner.

BRIEF DESCRIPTION OF THE INVENTION

In one embodiment, a connector assembly is provided that includes a shielded housing having a cavity. The shielded housing has a mating end and a cable end configured to receive a cable therethrough. A plug is received in the cavity that has terminals extending between mating ends and wire terminating ends. The wire terminating ends are configured to be terminated to corresponding wires of the cable. A cable clip is received in the shielded housing proximate to the cable end. The cable clip has a base and a bonding arm extending from the base. The base engages and is electrically connected to the shielded housing. The bonding arm is positioned in the cavity and is configured to engage a cable shield of the cable to electrically connect the cable shield and the shielded housing.

In another embodiment, a connector assembly is provided that includes a shielded housing having an upper shell and a lower shell defining a cavity. The shielded housing has a center plate received in the cavity and held between the upper and lower shells. The upper shell has at least one upper plug chamber and the lower shell has at least one lower plug chamber. The center plate is positioned between, and provides shielding between, the upper and lower plug chambers. The shielded housing has a mating end and a cable end configured to receive a cable therethrough. Plugs are received in corresponding plug chambers. The plugs have terminals extending between mating ends and wire terminating ends that are configured to be terminated to corresponding wires of the cable. A cable clip is received in the shielded housing proximate to the cable end. The cable clip has a base and a bonding arm extending from the base. The base engages and is electrically connected to the shielded housing. The bonding arm is positioned in the cavity and is configured to engage a cable shield of the cable to electrically connect the cable shield to the shielded housing.

In a further embodiment, a connector assembly is provided including a shielded housing having an upper shell and a lower shell defining a cavity. The shielded housing has a center plate received in the cavity and held between the upper and lower shells. The upper shell has at least one upper plug chamber and the lower shell has at least one lower plug chamber. The center plate is positioned between, and provides shielding between, the upper and lower plug chambers. The shielded housing has a mating end and a cable end configured to receive a cable therethrough. Plugs are received in corresponding plug chambers. The plugs have terminals extending between mating ends and wire terminating ends that are configured to be terminated to corresponding wires of the cable. A cable clip is received in the shielded housing proximate to the cable end. The cable clip has a base and a bonding arm extending from the base. The base engages and is electrically connected to the shielded housing. The bonding arm is positioned in the cavity and is configured to engage a cable shield of the cable to electrically connect the cable shield to the shielded housing. The cable clip includes a retention arm being positioned in the cavity that is configured to engage a cable jacket of the cable to provide cable strain relief.

DETAILED DESCRIPTION OF THE INVENTION

Figure 1:
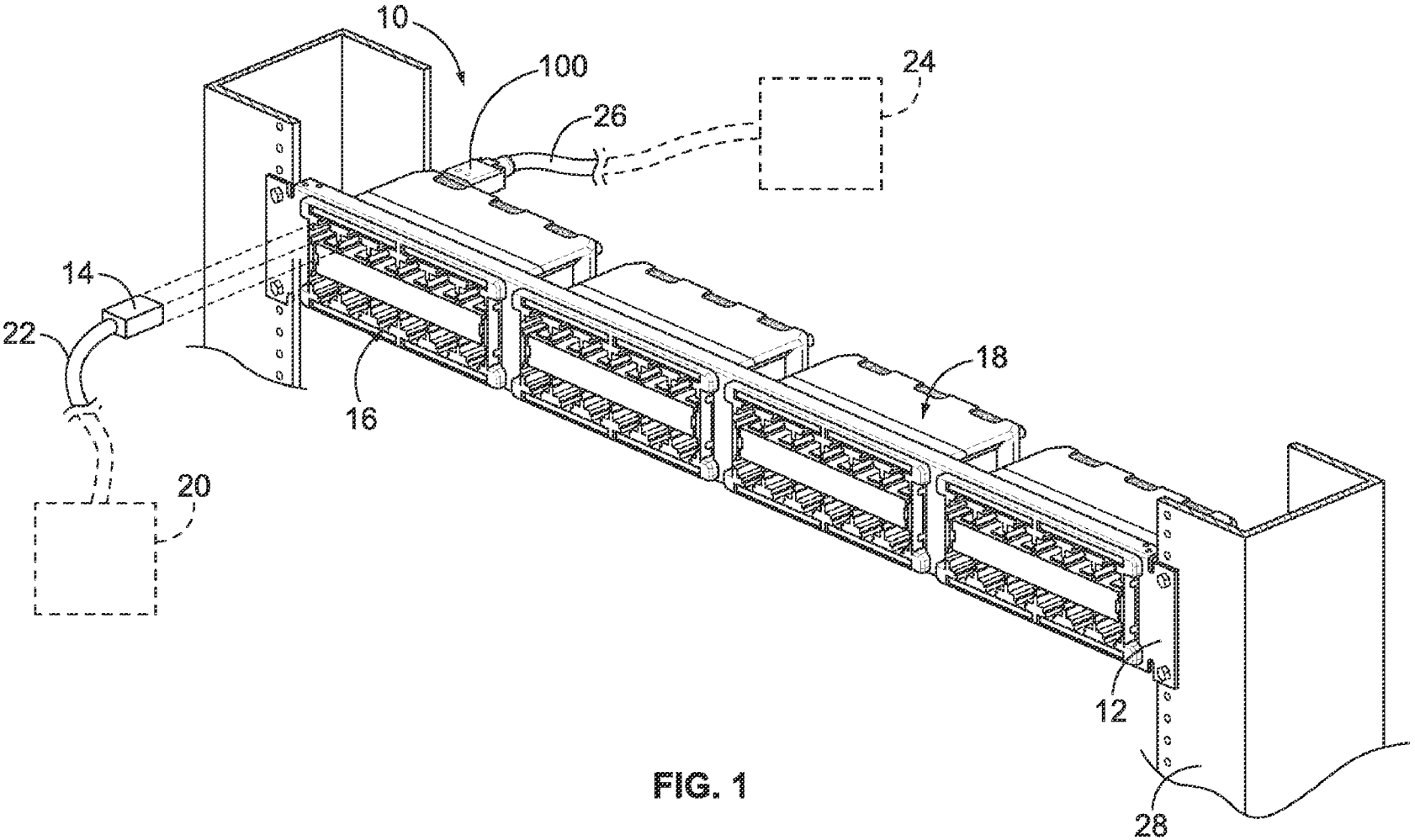
FIG. 1 is a front perspective view of a portion of a cable interconnect system illustrating a panel and a plurality of cassettes mounted to the panel.

FIG. 1 is a front perspective view of a portion of a cable interconnect system 10 illustrating a panel 12 and a plurality of cassettes 18 mounted to the panel 12. FIG. 1 also illustrates a modular plug 14 connected to one of the cassettes 18. The cassette 18 comprises an array of receptacles 16 for accepting or receiving the modular plug 14.

The cable interconnect system 10 is utilized to interconnect various equipment, components and/or devices to one another. FIG. 1 schematically illustrates a first device 20 connected to the cassette 18 via a cable 22. The modular plug 14 is attached to the end of the cable 22. FIG. 1 also illustrates a second device 24 connected to the cassette 18 via a cable 26, such as a multi-pair cable having multiple wire pairs. A multi-plug connector assembly 100 is provided at the end of each cable 26, which is connected to a back end of the cassette 18. Optionally, a latch assembly 160 may be used to secure the connector assembly 100 to the cassette 18, such as the latch assembly described in U.S. patent application, having Ser. No. 12/688,284 and titled "LATCH ASSEMBLY FOR A CONNECTOR ASSEMBLY", the complete subject matter of which is incorporated by reference in its entirety.

The cassette 18 interconnects the first and second devices 20, 24. In an exemplary embodiment, the first device 20 may be a computer Ideated remote from the cassette 18. The second device 24 may be a network switch. The second device 24 may be located in the vicinity of the cassette 18, such as in the same equipment room, or alternatively, may be located remote from the cassette 18. The cable interconnect system 10 may include a support structure 28, a portion of which is illustrated in FIG. 1, for supporting the panel 12 and the cassettes 18. For example, the support structure 28 may be an equipment rack of a network system. The panel 12 may be a patch panel that is mounted to the equipment rack. In a typical system, multiple panels 12 may be stacked within the support structure 28. The panels 12 may be sized to fit a standard rack specification, such as that defined in EIA-310. For example, the panels 12 may have a one rack unit height, or 1U height, of 1.75 inches. In alternative embodiments, rather than a patch panel, the panel 12 may be another type of network component used with a network system that supports cassettes 18 and/or other connector assemblies, such as interface modules, stacked jacks, or other individual modular jacks. For example, the panel 12 may be a wall or other structural element of a component. It is noted that the cable interconnect system 10 illustrated in FIG. 1 is merely illustrative of an exemplary system/component for interconnecting communication cables using modular jacks and modular plugs or other types of connectors. Optionally, the second device 24 may be mounted to the support structure 28.

Figure 2:
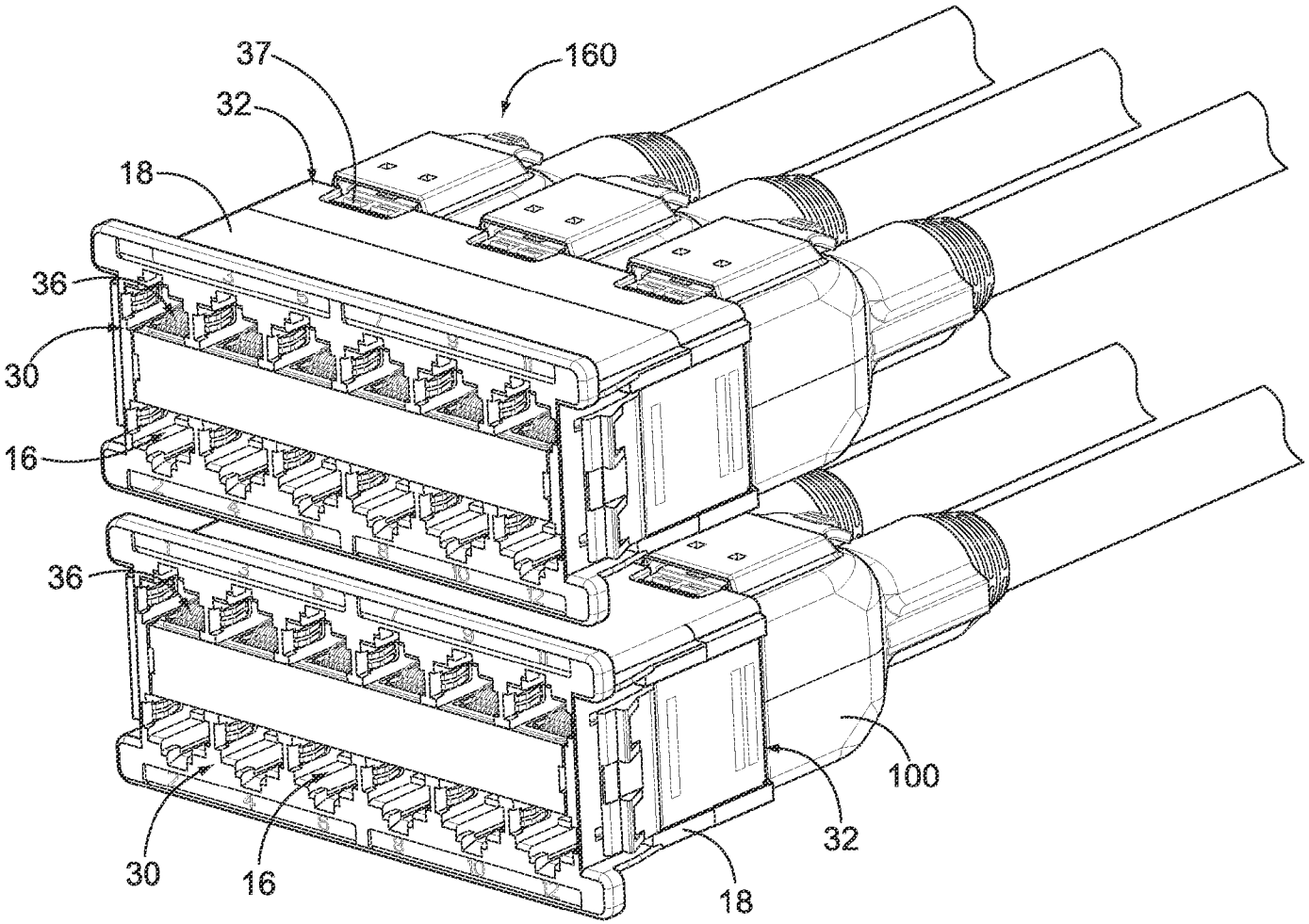
FIG. 2 is a front perspective view of a plurality of stacked cassettes with the corresponding panels removed illustrating a plurality of connector assemblies mated with the cassettes.

FIG. 2 is a front perspective view of a plurality of stacked cassettes 18 with the corresponding panels 12 (shown in FIG. 1) removed illustrating a plurality of multi-plug connector assemblies 100 mated with the cassettes 18. The cassettes 18 may be substantially similar to the cassettes described in U.S. patent application Ser. No. 12/394,987, Titled SHIELDED CASSETTE FOR A CABLE INTERCONNECT SYSTEM, the complete subject matter of which is hereby incorporated by reference in its entirety.

The cassette 18 includes a front mating interface 30 and a rear mating interface 32. The modular plugs 14 (shown in FIG. 1) are mated with the cassettes 18 at the front mating interface 30. The multi-plug connector assemblies 100 are mated with the cassettes 18 at the rear mating interface 32. The cassette 18 includes a plurality of receptacles 16 open at the front mating interface 30 for receiving the modular plugs 14. In an exemplary embodiment, the receptacles 16 are arranged in a stacked configuration in a first row and a second row. A plurality of receptacles 16 are arranged in each of the first and second rows. In the illustrated embodiment, six receptacles 16 are arranged in each of the first and second rows, thus providing a total of twelve receptacles 16 in each cassette 18. It is realized that the cassettes 18 may have more or less than twelve receptacles 16 arranged in more or less than two rows.

Communication modules 36 are held within the cassette 18 for interfacing with the modular plugs 14 and the multi-plug connector assemblies 100. The communication modules 36 are exposed within the receptacles 16 for mating with the modular plugs. The communication modules 36 also extend to the rear mating interface 32 for interfacing with the connector assemblies 100. Optionally, the communication modules 36 at the rear mating interface 32 may define a quad-type mating interface configured to receive a quad-type plug connector therein. The communication modules 36 each include contacts 42. Optionally, the contacts 42 may be arranged in pairs in different quadrants of corresponding plug cavities at the rear mating interface 32. It is realized that the contacts 42 at the front mating interface may be different than the contacts 42 at the rear mating interface 32. For example, the contacts at the front mating interface may be electrically connected to the contacts 42 at the rear mating interface 32 by a circuit board or other components therebetween, or may be direction connected together. Alternatively, individual contacts may extend between both the front mating interface and the rear mating interface 32.

Data is transferred by the communication modules 36 between the modular plugs 14 and the corresponding connector assemblies 100. Each multi-plug connector assembly 100 may be electrically connected to more than one communication module 36. For example, each connector assembly 100 is electrically connected to four communication modules 36, and thus communicate with four different modular plugs 14. In the illustrated embodiment, the communication modules 36 are configured to mate with an 8 position, 8 contact (8P8C) type of plug, such as an RJ-45 plug or another copper-based modular plug type of connector at the front mating interface 30. Alternatively, the communication modules 36 may be configured to mate with different types of plugs, such as other copper based types of plugs (e.g. a quad-plug) or fiber-optic types of plugs. The communication modules 36 are configured to mate with a different type of plug at the rear mating interface 32, however the mating interfaces at the front and rear of the communication modules 36 may be the same in some alternative embodiments.

The latch assemblies 160 securely couple the connector assemblies 100 to the cassettes 18. Notably, the cassettes 18 include catches 37 that interact with the latch assemblies 160 to secure the connector assemblies 100 to the cassettes 18. The latch assemblies 160 may be unlatched to remove the connector assemblies 100 from the cassettes 18. In an exemplary embodiment, the latch assemblies 160 are electrically connected to the cassettes 18 and to the connector assemblies 100. As such, the latch assemblies 160 electrically common the cassettes 18 and the connector assemblies 100. When electrically commoned, the cassettes 18 and the connector assemblies 100 are at the same electrical potential. Optionally, the latch assemblies 160 create a ground path between the connector assemblies 100 and the cassettes 18, such as when the cassettes 18 are grounded, such as to earth ground or chassis ground.

Figure 3:
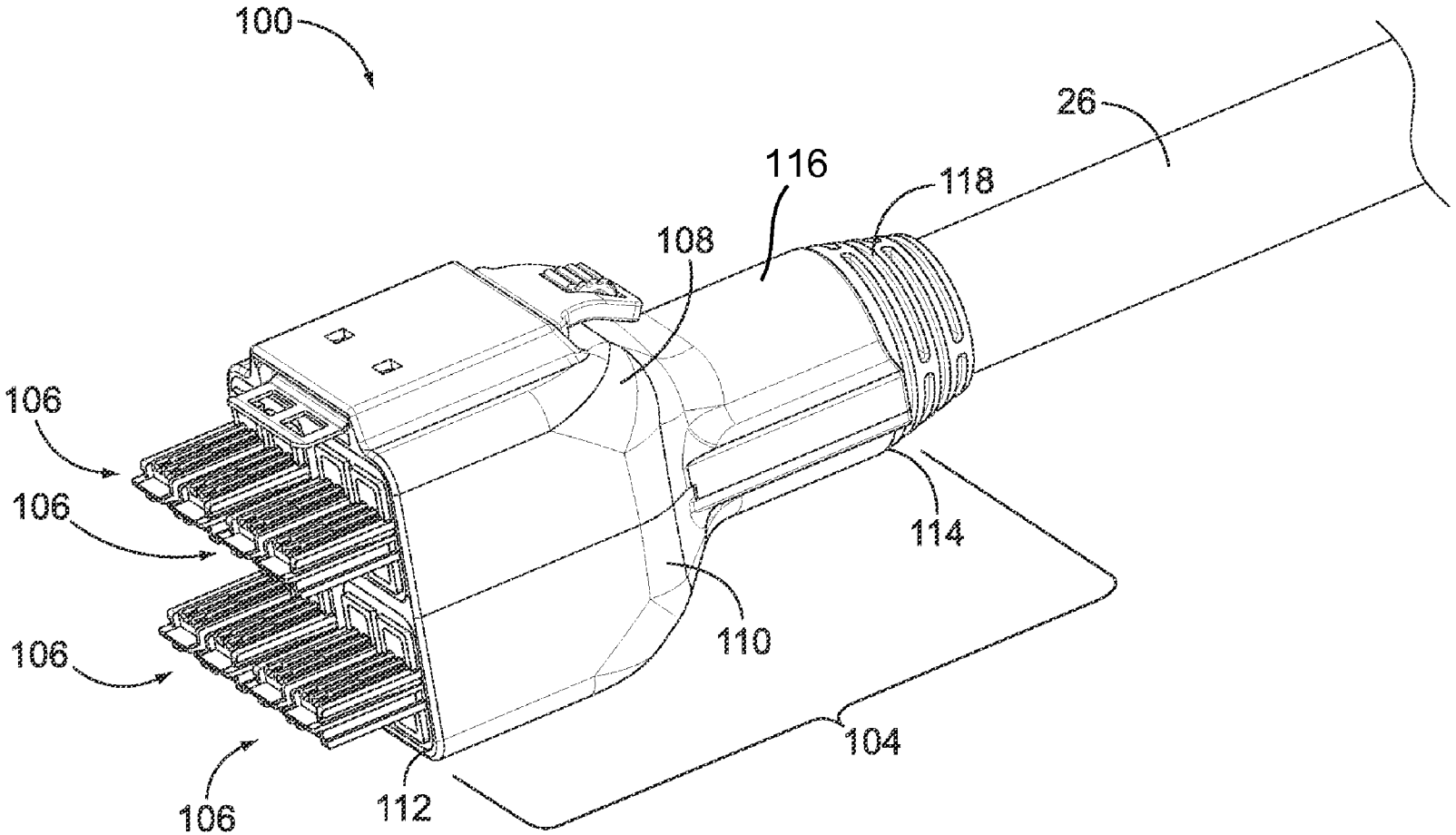
FIG. 3 is a side perspective view of an exemplary connector assembly for mating with the cassette shown in FIG. 1.

FIG. 3 is a front perspective view of an exemplary connector assembly 100 for mating with the cassette 18 (shown in FIG. 1). The connector assembly 100 is terminated to an end of the cable 26. The cable 26 is a multi-pair cable having multiple cables therein each having individual wire pairs that are terminated to corresponding terminals 102, which mate with the contacts 42 (shown in FIG. 2) of the communication module 36 (shown in FIG. 2) at the rear mating interface 32 (shown in FIG. 2). Optionally, the cable 26 may be shielded and includes a cable shield, such as a cable braid or a conductive foil, surrounding each of the individual cables held therein. Optionally, each of the individual cables held in the cable 26 may be additionally, or alternatively, individually shielded by a corresponding cable shield, such as a cable braid or a conductive foil. A shielded housing 104 of the connector assembly 100 is configured to be electrically bonded to the cable shield of the cable 26 and/or the cable shields of the individual cables held in the cable 26.

The shielded housing 104 includes a cavity 105 (shown in FIG. 4) that holds a plurality of individual and discrete plugs 106. Each plug 106 is configured to be terminate to an end of a corresponding cable held within the cable 26 and is configured to mate with a corresponding communication module 36. As such, when the connector assembly 100 is mated to the cassette 18 (shown in FIG. 1), multiple plugs 106 are simultaneously mated with corresponding communication modules 36.

The shielded housing 104 includes an upper shell 108 and a lower shell 110 coupled together to define the cavity 105. The shielded housing 104 extends between a mating end 112 and a cable end 114. The cavity 105 is open between the mating end 112 and the cable end 114 for receiving the plugs 106 and the cable 26. The cable 26 passes into the shielded housing 104 through a boss 116 at the cable end 114. The boss 116 provides strain relief for the cable 26. Optionally, a ferrule 118 may be provided at the cable end 114 to provide strain relief for the cable 26.

Figure 4:
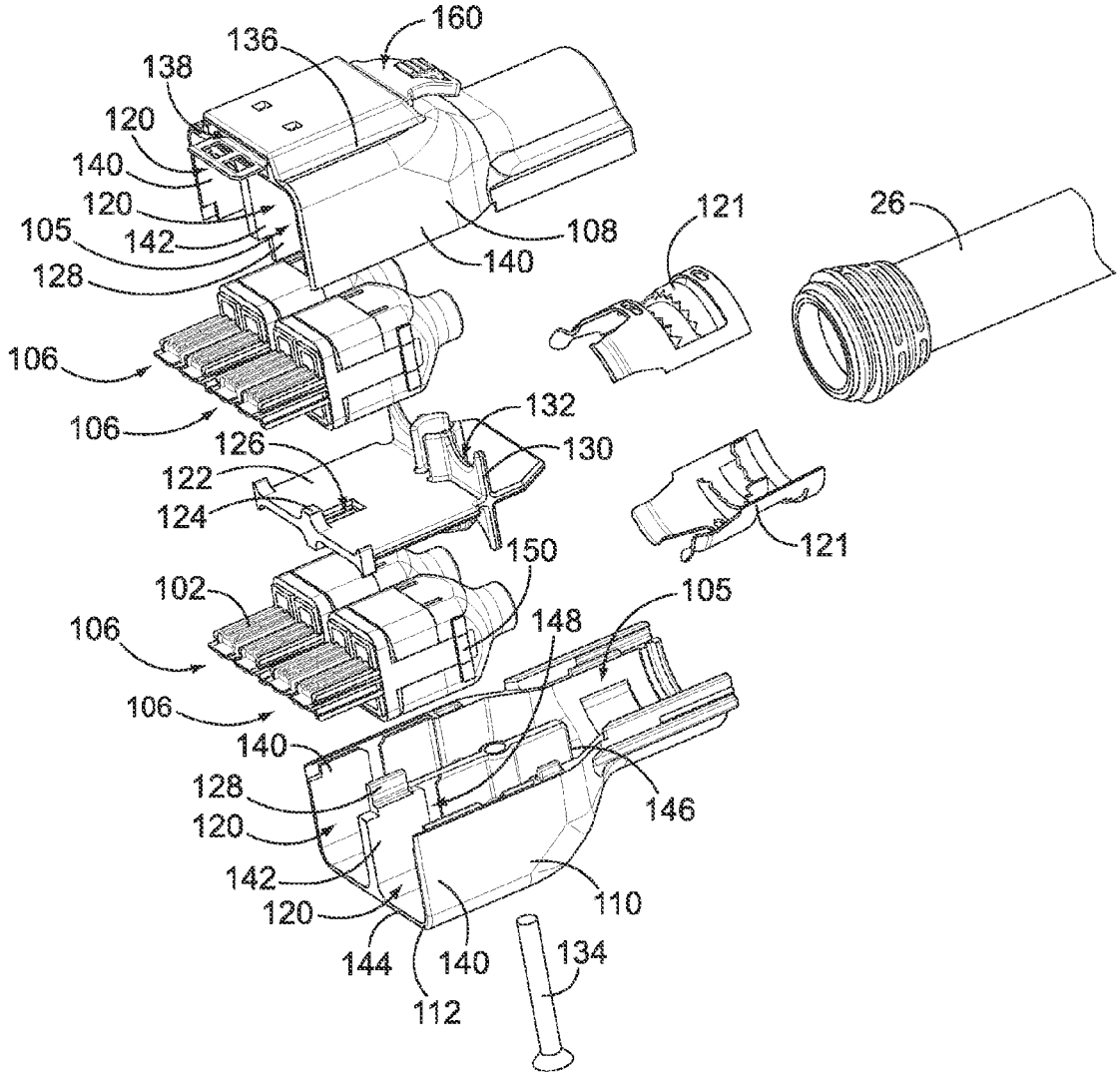
FIG. 4 is an exploded view of the connector assembly shown in FIG. 3.

FIG. 4 is an exploded view of the connector assembly 100 showing the individual plugs 106. Optionally, the plugs 106 may be similar to the plugs described in copending U.S. patent application, having Ser. No. 12/688,236 and titled "PLUG ASSEMBLY", the complete subject matter of which is incorporated herein by reference in its entirety. The plugs 106 are separate from one another and are individually terminated to corresponding cables and associated wires (not shown) of the cable 26. Optionally, each plug 106 may be terminated to multiple wire pairs extending from the cable 26. For example, in one exemplary embodiment, each plug 106 is terminated to four wire pairs, or eight wires. Once the plugs 106 are terminated to the wires, the connector assembly 100 may be assembled.

A pair of cable clips 121 are loaded into the cavity 105 of the shielded housing 104. Any number of cable clips 121, including a single cable clip 121, may be utilized in alternative embodiments. Each cable clip 121 may be loaded into the boss 116. When loaded, the cable clip 121 engages, and is electrically connected to, the shielded housing 104. Furthermore, the cable clip 121 is positioned within the cavity 105 such that the cable clip 121 engages the cable 26 and/or the individual cables or wires within the cable 26. In an exemplary embodiment, the cable clip 121 engages the cable shield, or other conductive, shielded portion of the cable 26 or individual cables or wires held by the cable 26, such that the cable clip 121 is electrically connected and bonded to such cable shield or shielded portion thereof. The cable clip 121 creates a conductive pathway between the cable shield and the shielded housing 104 to electrically bond the shielded housing 104 and the cable 26.

During assembly, the plugs 106 are loaded into the shielded housing 104. The shielded housing 104 is fabricated from a metal material, such as an aluminum or aluminum alloy, and thus provides shielding for the plugs 106. In an exemplary embodiment, the plugs 106 are loaded into separate, shielded plug chambers 120 that are defined by the shielded housing 104. As such, the individual plugs 106 are shielded from one another to reduce or prevent cross-talk.

In the illustrated embodiment, the upper shell 108 includes two upper plug chambers 120 and the lower shell 110 includes two lower plug chambers 120. As such, four individual plugs 106 are provided within the connector assembly 100, defining a quad connector assembly 100. However, it is realized that any number of plug chambers 120 may be defined by the upper shell 108 and/or the lower shell 110. Optionally, the upper shell 108 and/or the lower shell 110 may each only have one plug chamber 120. It is also realized that the designation of upper and lower may be different if the connector assembly 100 were rotated 90°, such as to a left/right designation rather than an upper/lower designation.

The shielded housing 104 includes a center plate 122 between the upper and lower shells 108, 110. The center plate 122 engages, and is electrically connected to, the shielded housing 104. The center plate 122 is captured between the upper and lower shells 108, 110 when the connector assembly 100 is assembled. The center plate 122 separates the upper and lower plug chambers 120, and provides shielding between the upper and lower plug chambers 120. The center plate 122 is fabricated from a metal material, such as an aluminum or aluminum alloy, and thus provides shielding for the plug chambers 120. The center plate 122 includes supporting features 124 that support the individual plugs 106 and hold the plugs 106 in the shielded housing 104. The supporting features 124 engage select portions of the plugs 106 to electrically common the shielded housing 104 and the plugs 106. When electrically commoned, the plugs 106 and the shielded housing 104 are at the same electrical potential.

In an exemplary embodiment, the center plate 122 includes one or more opening(s) 126 therethrough. Fingers 128 of the upper and lower shells 108, 110 extend into and through the opening 126 to engage one another. The fingers 128 electrically common the upper and lower shells 108, 110 to one another. When electrically commoned, the upper and lower shells 108, 110 are at the same electrical potential. The fingers 128 may engage the center plate 122 to electrically common the upper and lower shells 108, 110 to the center plate 122. When electrically commoned, the upper and lower shells 108, 110 and the center plate 122 are at the same electrical potential. Other portions of the center plate 122 may also engage the upper and lower shells 108, 110 to electrically common the center plate 122 with the upper and lower shells 108, 110. Optionally, the cable clip 121 may engage the center plate 122 to electrically common the cable clip 121 and the center plate 122.

The center plate 122 includes flanges 130 that extend both upward and downward therefrom. The flanges 130 are positioned near the back ends of the plugs 106 when the connector assembly 100 is assembled and provide shielding behind the plugs 106. The flanges 130 include cut-outs 132 for the wires and/or the extreme back end of the plugs 106 to pass through.

A fastener 134 is used to securely couple the upper and lower shells 108, 110 together, and the fastener 134 extends through the center plate 122. Other types of securing means or features may be used in alternative embodiments, such as latches.

The upper and lower shells 108, 110 may be substantially identical to one another, representing mirrored halves. However, the upper and lower shells 108, 110 may be different from one another in other embodiments. The upper shell 110 includes a top 136 having a latch chamber 138. The latching assembly 160 is received in the latch chamber 138. A portion of the latching assembly 160 extends from the front of the latch chamber 138. A portion of the latching assembly 160 extends from the rear of the latch chamber 138.

Both shells 108, 110 include exterior shield walls 140. When multiple plug chambers 120 are provided, the shells 108, 110 also include interior shield walls 142 separating adjacent plug chambers 120. The interior shield walls 142 are formed integrally with the exterior shield walls 140. For example, the shells 108, 110 may be die-cast to form the exterior and interior shield walls 140, 142. The exterior and interior shield walls 140, 142 extend from a front 144 to a rear 146 of the plug chambers 120 to provide continuous shielding from the front 144 to the rear 146. The interior shield walls 142 provide shielding between adjacent plug chambers 120 in either shell 108, 110. The center plate 122 also defines an interior shield wall that provides shielding between upper plug chambers 120 and lower plug chambers 120. The center plate 122 may engage, and be electrically connected to, the interior shield walls 142. Optionally, the cable clip 121 may engage the interior shield walls 142 to electrically common the cable clip 121 and the interior shield walls 142. The exterior shield walls 140 include channels 148 the receive protrusions 150 extending from the plugs 106. The channels 148 align the plugs 106 with respect to the shielded housing 104 and hold the plugs 106 in position within the plug chambers 120.

In the illustrated embodiment, the shielded housing 104 includes four plug chambers 120 arranged in quadrants. The interior shield walls 142 and the center plate 122, which also defines an interior shield wall, shield adjacent plug chambers 120 from one another. The exterior shield walls 140 and the interior shield walls 142 surround the periphery of the plug chambers 120. Each plug chamber 120 is bounded on two sides by exterior shield walls 140 and each plug chamber 120 is bounded on two sides by interior shield walls 142. Four plugs 106 are received in the four plug chambers 120. The connector assembly 100 thus defines a quad connector assembly 100. The cable 26 has wires that are terminated to each of the plugs 106 in the different quadrants of the shielded housing 104. As such, the connector assembly 100 includes a single cable 26 with four discrete plugs 106 arranged in quadrants. Additionally, as described in further detail below, each of the plugs 106 represents a quad-type plug having the individual terminals 102 arranged as pairs in quadrants of the plug 106.

Figure 5:
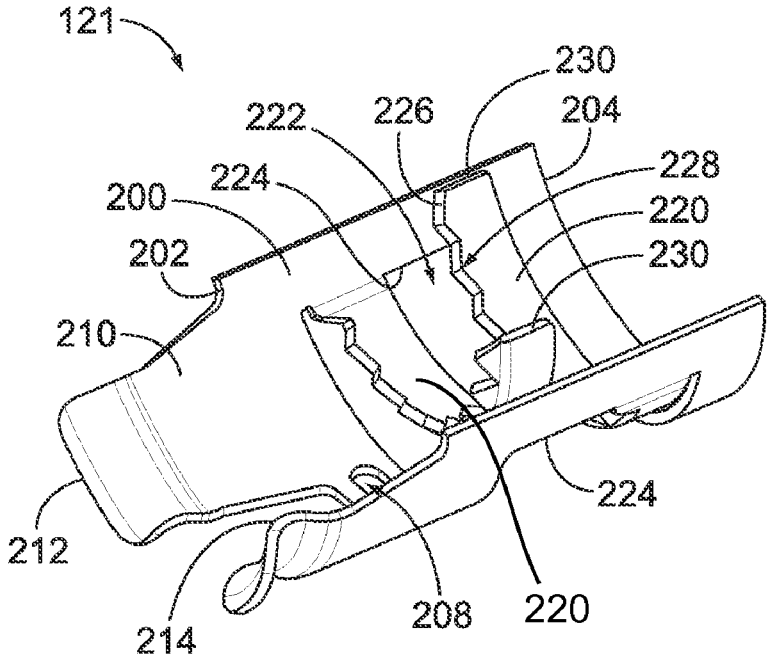
FIG. 5 is a front perspective view of a cable clip for the connector assembly shown in FIG. 3.
Figure 6:
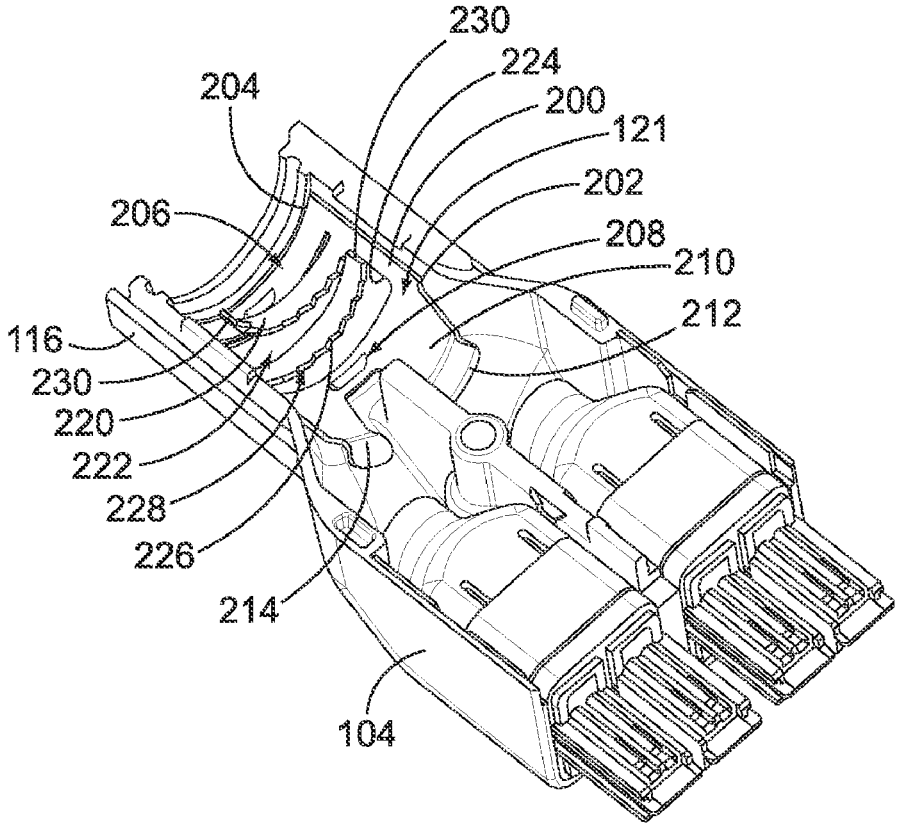
FIG. 6 illustrates the cable clip loaded into a portion of the connector assembly.

FIG. 5 is a front perspective view of the cable clip 121 for the connector assembly 100 (shown in FIG. 3). FIG. 6 illustrates the cable clip 121 loaded into a portion of the connector assembly 100. The cable clip 121 is fabricated from a conductive material, such as a metal material or a plated plastic material. In an exemplary embodiment, the cable clip 121 is a stamped and formed part stamped from a metal sheet of material and formed into a predetermined shape. The base 2 is configured to engage the shielded housing 104 to electrically connect the cable clip 121 to the shielded housing 104.

The cable clip 121 includes a base 200 extending between a front 202 and a rear 204. The base 200 is shaped to be received within the shielded housing 104. For example, the base 200 is curved to fit within the boss 116 (shown in FIG. 2). Optionally, the base 200 may define a half cylinder wherein the cable clip 121 is utilized with a second cable clip to circumferentially surround a receiving space 206 (shown in FIG. 6) for the cable 26 (shown in FIG. 1). The base 200 includes one or more securing features 208 for securing the cable clip 121 to the shielded housing 104. Optionally, the securing feature 208 may be an opening or slot that receives a tab or protrusion extending from the shielded housing 104. Other types of securing features may be used in alternative embodiments.

The cable clip 121 includes one or more bonding arms 210 extending from the front 202 of the base 200. The bonding arms 210 are cantilevered from the base 200 and extend to a distal end 212 generally along a longitudinal axis that is parallel to the cable axis. Alternatively, the bonding arms 210 may extend generally perpendicular to the cable axis or at an acute angle with respect to the cable axis. The bonding arms 210 are configured to engage the cable shield, or other shielded portion of the cable 26, to electrically connect the cable clip 121 to the cable 26. In an exemplary embodiment, the distal end 212 of the bonding arm 210 is curved to define an engagement surface 214 at a mating interface between the bonding arm 210 and the cable shield. The engagement surface 214 is inwardly curved such that the bonding arm 210 is transitioned inward into the receiving space 206 that receives the cable 26. The bonding arms 210 extend from the base 200 into the receiving space 206 such that the bonding arms 210 interfere with the cable 26 when the cable is loaded into the receiving space 206. The bonding arms 210 are flexed outward when the cable 26 is loaded into the receiving space 206. Such deflection of the bonding arms 210 creates a biasing force or normal force that presses the bonding arms 210 against the cable 26.

The cable clip 121 includes one or more retention arms 220 that extend into the receiving space 206 to engage the cable 26. For example, the retention arms 220 engage the cable jacket of the cable 26. The retention arms 220 are secured to the cable 26 to hold the cable 26 within the receiving space 206. The retention arms 220 function as strain relief elements that provide cable strain relief. In an exemplary embodiment, the base 200 includes an opening 222 approximately centrally located between the front 202 and the rear 204. The retention arms 220 extend into the opening 222. The retention arms 220 are cantilevered from respective edges 224 defining the opening 222. The retention arms 220 are bent inward such that the retention arms 220 are located within the receiving space 206. Optionally, the retention arms 220 may include a front edge 226 having teeth 228 configured to bite into the cable 26 when the cable 26 is loaded into the receiving space 206. The teeth 228 may extend substantially the entire length of the retention arms 220 between the edge 224 and a distal end 230 of the respective retention arms 220. When the teeth 228 engage the cable jacket of the cable 26, the retention arms 220 resist pulling of the cable 26 out of the receiving space 206.

In an alternative embodiment, the retention arms 220 may also define bonding arms that are electrically coupled to a shielded portion of the cable 26 or the individual cables held by the cable 26. The retention arms 220 may be positioned forward of the securing feature 208 in addition to, or in the alternative to, being positioned rearward of the securing feature 208 to engage the cable shield(s).

In the illustrated embodiment, the cable clip 121 includes two retention arms 220. A first of the retention arms 220 extends from one edge 224 while a second of the retention arms 220 extends from the opposite edge 224. The first retention arm 220 generally extends in a first direction across the opening 220 into the receiving space 206 while the second retention 220 generally extends in a second direction across the opening 222 into the receiving space 206. The second direction is generally opposite the first direction. Any number of retention arms 220 may be provided in alternative embodiments. In alternative embodiments, rather than being elongated strips, the retention arms 220 may be tabs extending into the receiving space 206 from the base 200, or rather than retention arms that are cantilevered the retention arms 220 may simply include the plurality of teeth which extend into the receiving space 206.

During use, the retention arms 220 are flexed outward by the cable 26 when the cable 26 is loaded into the receiving space 206. When the retention arms 220 are flexed outward, the retention arms 220 are biased against the cable 26 to ensure contact between the retention arms 220 and the cable 26.

Figure 7:
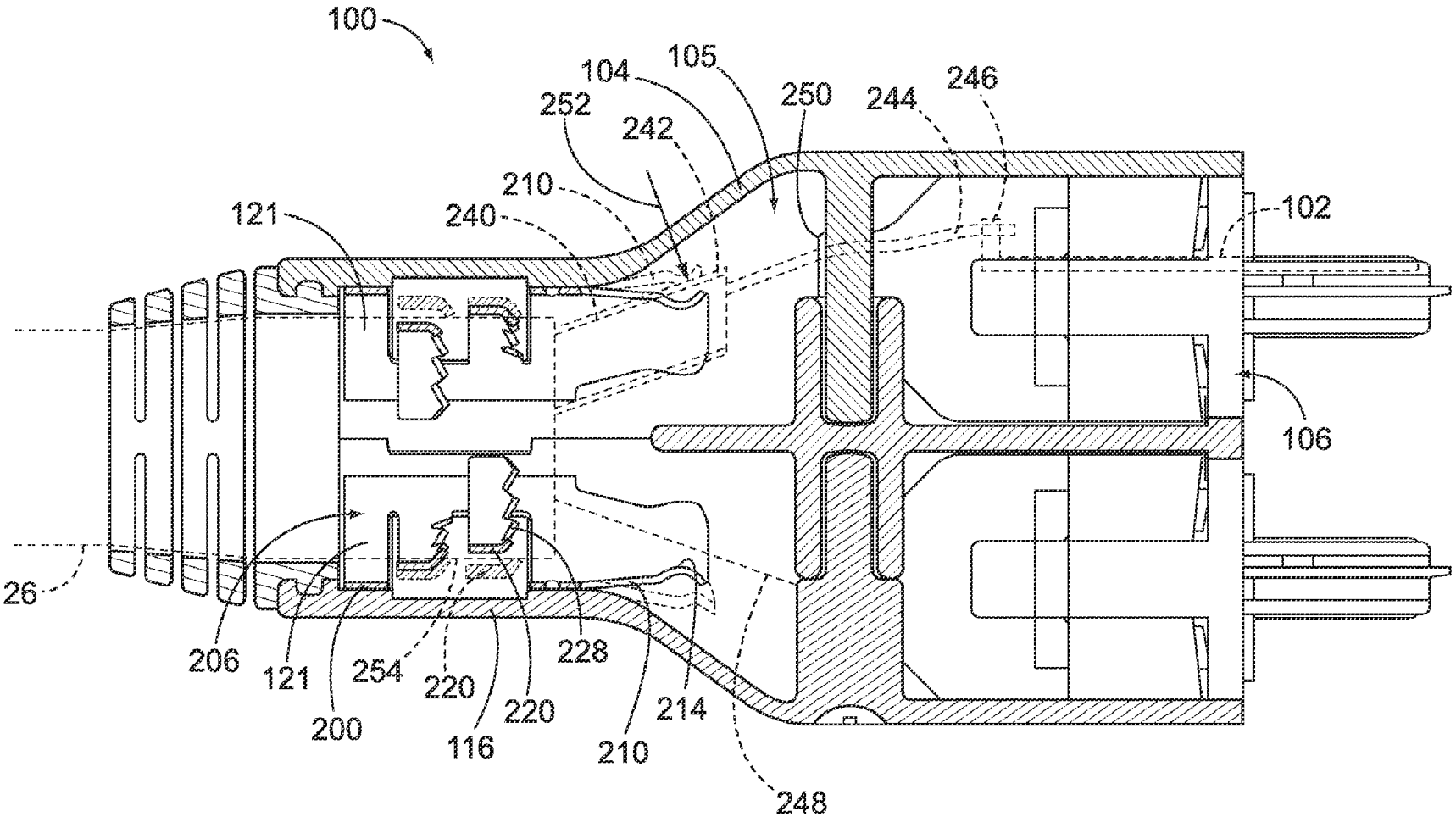
FIG. 7 is a cross-sectional view of the connector assembly shown in FIG. 3.

FIG. 7 is a cross-sectional view of the connector assembly 100 illustrating the cable clips 121 within the shielded housing 104. FIG. 7 illustrates the cable 26 in phantom with individual cables 240 extending from the interior of the cable 26. The individual cables 240 have cable shields 242 and a plurality of wires 244 that are configured to be terminated to wire terminating ends 246 of the terminals 102. The cable shields 242 may be conductive foils or cable braids circumferentially surrounding each of the wires 244 held therein. Optionally, the wire terminating ends 246 may be insulation displacement contacts where the wires are received therein to make electrical contact to the conductors of the wire 244. Alternatively, the wire terminating ends 246 may be solder pads, where the wires 244 are soldered to the solder pads. Optionally, the cable 26 may include four cables 240. Each cable 240 may include eight wires 244 that are terminated to the terminals 102.

The cable clip 121 is loaded into the boss 116 of the shielded housing 104. The base 200 rests flush against the interior of the shielded housing 104 to create an electrical connection therebetween. The bonding arms 210 extend forward from the base 200 into the cavity 105. The bonding arms 210 generally extend across a direct line path (represented by line 248 in FIG. 7) between the cable 26 and wire receiving ends 250 of the plugs 106. As such, when the cables 240 are routed from the cable 26 to the wire receiving ends 250, the cables 240 engage, and least partially displace, the bonding arms 210. Such displacement forces the bonding arms 210 outward towards the shielded housing 104 causing the bonding arms 210 to be deflected outward (the bonding arms 210 are shown deflected outward in phantom). Such deflection creates a bending moment within the bonding arms 210 which forces the bonding arms 210 to be biased against the cables 240.

The bonding arm 210 imparts a normal force against the cable 240 in a direction towards the center of the cavity 105 (shown by the arrow 252). The bonding arm 210 has a predetermined length from the base 200 such that the engagement surface 214 is aligned with the cable shield 242 of the corresponding cable 240. The engagement surface 214 is the portion of the bonding arm 210 that engages the cable 240. When the engagement surface 214 engages the cable shield 242, the cable clip 121 is electrically bonded to the cable shield 242. The bonding arms 210 of the upper cable clip 121 impart a normal force against the corresponding cable shields 242 in a generally downward direction, whereas the bonding arms 210 of the lower cable clip 121 impart a normal force against the corresponding cable shields 242 in a generally upward direction.

Returning to FIG. 6, the left hand bonding arm 210 of the cable clip 121 imparts a normal force against the corresponding cable shield 242 (shown in FIG. 7) in a direction that is generally upward and towards the right side of the shielded housing 104. The right hand bonding arm 210 imparts a normal force against the corresponding cable shield 242 in a direction that generally upward and toward the left of the shielded housing 104.

Returning to FIG. 7, the retention arms 220 extend into the receiving space 206 to engage a cable jacket 254 of the cable 26. The retention arms 220 are deflected outward from a normal position (shown in FIG. 7) to a deflected position (shown in phantom in FIG. 7) when the cable 26 is loaded into the receiving space 206. The retention arms 220 impart a normal force against the cable jacket 254 in a radially inward direction such that the retention arms 220 are biased against the cable jacket 254. The teeth 228 bite into the cable jacket 254 to secure the cable 26 within the receiving space 206. For example, rearward movement of the cable 26 is resisted by the interference between the teeth 228 and the cable jacket 254. Optionally, the retention arms 220 may circumferentially surround a majority of the cable jacket 254.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first." "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a shielded housing having a cavity, the shielded housing having a mating end and a cable end configured to receive cables therethrough;

a plurality of plugs received in the cavity, each plug having terminals extending between mating ends and wire terminating ends, the wire terminating ends being configured to be terminated to corresponding wires of the corresponding cable, the plurality of plugs being configured to be terminated to ends of different cables; and a cable clip received in the shielded housing proximate to the cable end, the cable clip having a base and a plurality of bonding arms extending from the base, the base engaging and being electrically connected to the shielded housing, the plurality of bonding arms being positioned in the cavity and being configured to engage a cable shield of a different cable to electrically connect the corresponding cable shield and the shielded housing, each bonding arm having a distal end, the distal end positioned proximate to the plug.

2. The connector assembly of claim 1, wherein the bonding arm is cantilevered from the base and movable within the cavity, the bonding arm being deflectable when engaging the cable shield such that the bonding arm is configured to be biased against the cable shield.

3. The connector assembly of claim 1, further comprising a plurality of cable clips received in the shielded housing proximate to the cable end, the bonding arms of the cable clips engaging cable shields of different cables.

4. The connector assembly of claim 1, wherein the plurality of bonding arms comprises a first bonding arm and a second bonding arm, the first bonding arm imparting a normal force against a corresponding cable shield in a first direction, the second bonding arm imparting a normal force against a corresponding cable shield in a different direction than the first bonding arm.

5. The connector assembly of claim 1, wherein each bonding arm is integrally formed with the base.

6. The connector assembly of claim 1, wherein the cable clip is fabricated from a conductive material forming a conductive path between the cable shield and the shielded housing.

7. The connector assembly of claim 1, wherein the bonding arm extends from the base toward the mating end of the shielded housing to the distal end.

8. The connector assembly of claim 1, wherein the cable clip further comprising a retention arm extending from the base, the retention arm being positioned in the cavity and being configured to engage a cable jacket of the cable to provide cable strain relief.

9. The connector assembly of claim 1, wherein the cable clip further comprises a retention arm extending from the base, the retention arm having teeth along an edge thereof, the teeth being configured to engage a cable jacket of the cable to provide cable strain relief.

10. The connector assembly of claim 1, wherein the cable clip includes a first retention arm extending from the base in a first direction and a second retention arm extending from the base in a second direction generally opposite to the first direction.

11. The connector assembly of claim 1, wherein the shielded housing includes an upper shell and a lower shell, the cable clip constitutes a first cable clip, the first cable clip being received in the upper shell, the bonding arm extending from the base in a first direction, the connector assembly further comprising a second cable clip received in the lower shell, the second cable clip having a second bonding arm extending into the cavity in a second direction that is different than the first direction.

12. A connector assembly comprising:

a shielded housing having an upper shell and a lower shell defining a cavity, the shielded housing having a center plate received in the cavity and held between the upper and lower shells, the upper shell having at least one upper plug chamber, the lower shell having at least one lower plug chamber, the center plate being positioned between, and providing shielding between, the upper and lower plug chambers, the shielded housing having a mating end and a cable end configured to receive a cable therethrough;

plugs received in corresponding plug chambers, the plugs having terminals extending between mating ends and wire terminating ends, the wire terminating ends being configured to be terminated to corresponding wires of the cable; and a cable clip received in the shielded housing proximate to the cable end, the cable clip having a base and a plurality of bonding arms extending from the base, the base engaging and being electrically connected to the shielded housing, each bonding arm being positioned in the cavity and being configured to engage a corresponding cable shield of the cable to electrically connect the cable shield and the shielded housing.

13. The connector assembly of claim 12, wherein each bonding arm is cantilevered from the base and movable within the cavity, the bonding arm being deflectable when engaging the cable shield such that the bonding arm is configured to be biased against the cable shield.

14. The connector assembly of claim 12, further comprising a plurality of cable clips received in the shielded housing proximate to the cable end, the bonding arms of the cable clips engaging cable shields of different cables.

15. The connector assembly of claim 12, wherein the plurality of bonding arms comprises a first bonding arm and a second bonding arm, the first bonding arm imparts a normal force against a corresponding cable shield in a first direction, the second bonding arm imparting a normal force against a corresponding cable shield in a different direction than the first bonding arm.

16. The connector assembly of claim 12, wherein each bonding arm has a distal end, the distal end being positioned proximate to the plugs.

17. A connector assembly comprising:

a shielded housing having an upper shell and a lower shell defining a cavity, the shielded housing having a center plate received in the cavity and held between the upper and lower shells, the upper shell having at least one upper plug chamber, the lower shell having at least one lower plug chamber, the center plate being positioned between, and providing shielding between, the upper and lower plug chambers, the shielded housing having a mating end and a cable end configured to receive a cable therethrough;

plugs received in corresponding plug chambers, the plugs having terminals extending between mating ends and wire terminating ends, the wire terminating ends being configured to be terminated to corresponding wires of the cable; and a cable clip received in the shielded housing proximate to the cable end, the cable clip having a base engaging and being electrically connected to the shielded housing, the cable clip having a plurality of bonding arms extending from the base, each bonding arm being positioned in the cavity and being configured to engage a corresponding cable shield of the cable to electrically connect the cable shield and the shielded housing, the cable clip having a retention arm being positioned in the cavity and being configured to engage a cable jacket of the cable to provide cable strain relief.

18. The connector assembly of claim 17, wherein the each bonding arm has a distal end, the distal end being positioned proximate to the plugs.

19. The connector assembly of claim 17, wherein the plurality of bonding arms comprises a first bonding arm and a second bonding arm, the first bonding arm imparts a normal force against a corresponding cable shield in a first direction, the second bonding arm imparting a normal force against a corresponding cable shield in a different direction than the bonding arm.

* * * * *